United States Patent [19]

Pollman

[11] 4,426,194

[45] Jan. 17, 1984

[54] VISCOSITY COMPENSATING CIRCUITS

[75] Inventor: Frederic W. Pollman, Ames, Iowa

[73] Assignee: Sundstrand Corporation, Rockford, Ill.

[21] Appl. No.: 241,160

[22] Filed: Mar. 6, 1981

[51] Int. Cl.[3] ..... F04B 49/00

[52] U.S. Cl. ..... 417/218; 60/329; 60/444; 60/452; 73/202

[58] Field of Search ..... 417/218–222; 60/443, 444, 452, 449, 447, 329; 137/82, 92, 467.5; 73/202

[56] References Cited

U.S. PATENT DOCUMENTS

| | | | |
|---|---|---|---|
| 2,005,731 | 6/1935 | Ernst et al. | 60/52 |
| 2,238,061 | 4/1941 | Kendrick | 417/357 |
| 2,297,408 | 9/1942 | Hardebeck | 73/202 |
| 3,556,160 | 1/1971 | Link et al. | 137/467.5 X |
| 3,687,160 | 8/1972 | Erickson et al. | 137/599.1 |
| 3,820,920 | 6/1974 | Klimaszewski et al. | 417/218 X |
| 3,922,853 | 12/1975 | Kalb | 60/325 |
| 4,032,259 | 6/1977 | Brown | 417/43 |
| 4,167,853 | 9/1979 | Hamma et al. | 60/329 |
| 4,325,677 | 4/1982 | Nonnenmacher | 417/218 |

OTHER PUBLICATIONS

Product Engineering, Aug. 1977, pp. 21 and 22.

*Primary Examiner*—Edward K. Look
*Attorney, Agent, or Firm*—Ted E. Killingsworth; Michael B. McMurry; Harold A. Williamson

[57] ABSTRACT

The present invention is directed to a simplified viscosity compensating circuit which utilizes a viscosity sensitive capillary and a flow restriction means in series therewith to regulate the pressure at a particular point in a control circuit in response to a change in viscosity of the control fluid. Such viscosity compensation in the circuit is utilized to either maintain a uniform pressure at the circuit output or off-set an adverse condition caused by a change in viscosity of the control fluid.

17 Claims, 3 Drawing Figures

VISCOSITY COMPENSATING CIRCUITS

TECHNICAL FIELD

The present invention relates to viscosity compensating means utilized in a hydraulic control circuit to either cancel an adverse effect due to a change in fluid viscosity and thus leave performance unchanged or use the viscosity effect to alter the performance to a new, more desirable condition.

BACKGROUND ART

In hydraulic power systems the viscosity of the hydraulic fluid changes as the fluid temperature changes. Changes in the viscosity of the fluid affect the pressure drop as the fluid flows through the lines and other elements of the circuit, the change of pressure drop being usually proportional to the change in fluid viscosity. Furthermore, pump efficiency and the resulting pump output flow are also viscosity sensitive and also affect the pressure drop. Under unusually cold ambient temperature conditions, the viscosity of the hydraulic fluid increases considerably which can reduce performance of the system and possibly cause a malfunction. This is particularly true since some hydraulic elements such as control lines or pump inlet lines are designed to operate within a narrow pressure drop range.

The adverse effects of a change of viscosity of a hydraulic fluid in a control system have been known for years. Furthermore, attempts in the past have been made to correct for or cancel the effect of a change of viscosity including the use of a viscosity sensitive elongated resistance or capillary. However, the past teachings normally utilize complicated hydraulic circuits including pressure regulator valves in order to maintain the desired pressure and flow.

One such teaching is U.S. Pat. No. 2,005,731 wherein a viscosity sensitive resistance is in series with a variable restriction. The change in pressure drop across the resistance, caused by an increase in viscosity of the fluid, is utilized to control a pressure regulator valve which modulates the flow of the control fluid to drain from a point in a hydraulic circuit between the viscosity sensitive resistance and the variable restriction. It is particularly noted that both the sensing means and the control means are in series with the working cylinder. Thus an increase in viscosity of the fluid causes a pressure drop through both the viscosity sensitive resistance and a pressure drop through the variable restriction which are in series with each other.

U.S. Pat. No. 3,922,853 discloses a hydraulic circuit with a viscosity sensitive capillary in parallel with a first adjustable restriction and in series with a second adjustable restriction. However, a pressure regulator valve is used to control the output pressure. Thus, the output pressure is not established by either restriction, but by the pressure regulator valve.

U.S. Pat. No. 4,167,853 teaches a hydrostatic vehicle transmission control which has a capillary or throttle in series with a fixed orifice to compensate for a change in viscosity of the control fluid. However, also located in the circuit is a spring biased pressure relief valve which limits the pressure, not the flow, of the system. The viscosity sensitive capillary thus does not modify an adverse viscosity induced flow characteristic across a flow control means.

DISCLOSURE OF THE INVENTION

The primary feature of the invention disclosed herein is to provide a simplified viscosity compensating circuit which regulates the pressure at a particular point in the circuit in response to a change in viscosity of the control fluid. Such viscosity compensation in the circuit is utilized to either cancel an adverse effect to leave performance unchanged or use the viscosity effect to alter performance of a system including the circuit to a new, more desirable condition.

Certain elements of a hydraulic control circuit are relatively insensitive to the change in viscosity of the control fluid. One such element is a fixed orifice. However, most elements in a hydraulic circuit are sensitive to a change in viscosity of the fluid flowing therethrough. This has been found to be particularly true of elements with movable parts like pumps and variable control elements. Thus valves, variable orifices and the like, due to the practical construction thereof, tend to be extremely sensitive to a change in viscosity. Most control circuits are designed to operate effectively within a relatively narrow range of fluid viscosity and thus a large change in viscosity of the control fluid, such as caused by adverse temperature conditions, causes a considerable effect on hydraulic systems and in some cases may be damaging to elements thereof. Thus, a control system designed to operate with warm hydraulic fluid can be ineffective due to cold ambient temperatures which cause an increase in viscosity of the hydraulic oil.

It is therefore an object of the present invention to correct for oil viscosity effects in a fluid circuit by measuring the viscosity with a viscosity sensitive capillary tube and use the signal to either cancel the viscosity effect and thus leave performance unchanged or use the viscosity effect to alter the performance to a new, more desirable condition.

It is a primary object of the present invention to provide a hydraulic compensating means for a hydraulic circuit which is sensitive to and corrects for changes in viscosity of the hydraulic fluid by utilizing a pressure drop induced by flow through a capillary which is proportional to flow though a control element in the circuit.

It is another object of the present invention to provide viscosity compensating means for a hydraulic control circuit which utilizes elements which do not have moving parts, is simply to produce, and is relatively inexpensive.

In one preferred form of the present invention, it is an object to provide a viscosity compensating means for a hydraulic circuit which cancels an adverse effect caused by changes in the fluid viscosity, whereby a given flow in the circuit provides a uniform pressure output regardless of the change in viscosity of the hydraulic fluid.

In a second preferred form of the present invention, it is an object of the present invention to modify a control signal to vary the input to the system, by utilizing a viscosity compensating means in conjunction with a modulating control, to off-set any adverse effects due to changes in fluid viscosity.

It is a further object of the present invention to provide a viscosity compensating control circuit which includes a control line having a source of fluid flow, an output line connected to the control line, flow control means in the control line to establish fluid pressure in the output line and wherein the control means is sensitive to a change in fluid viscosity and has a pressure drop related to flow, and the control circuit further including viscosity compensating means associated with the control line to modify the fluid flow through the control line upon a change in fluid viscosity to maintain a control pressure in the output line that is insensitive to the change in fluid viscosity regardless of the flow at the source.

It is also an object of the present invention to provide a viscosity compensating control circuit including a source of fluid flow, a first line including a control element which is pressure sensitive to flow, a second line in parallel flow relationship to the first line and including a capillary and an orifice in series flow relationship, a control line connected to the second line between the capillary and the orifice, the first and second lines being connected to the source of fluid flow whereby flow is provided to the control element and through the capillary to the control line and the flow restriction means which are in parallel relationship, the flow across said flow restriction means and to the control element determining the amount of flow across the capillary, and the pressure drop across the capillary modifies pressure upstream of the control element to compensate for changes in viscosity of the fluid.

BRIEF DESCRIPTION OF THE DRAWINGS

FIG. 1 shows a control circuit which may be used to send an output signal $S_o$ a control system (not shown). The signal $S_o$ may be utilized for various purposes, but in the form taught in FIG. 1, $S_o$ is contemplated to be a speed signal proportional to the speed of a pump 10 and as such could be utilized in an anti-stall control or in a power sensing control. As contemplated, the pump 10 is a prime mover driven, fixed displacement pump providing fluid flow to a control line 12. The control line 12 is provided with a fluid flow control means 14 and a discharge 16 to a reference pressure such as sump or drain 18. In the alternative, the discharge 16 may be to a relief line. The flow control element 14, in its most simplified form, is a variable orifice which may be changed in size for adjustment purposes. Connected to the control line 12, between the pump 10 and the variable orifice 14, is a branch line 20 which at $S_o$ provides the pressure signal which is the output of the control circuit. By utilizing the variable orifice 14 to control the flow of control fluid through control line 12 to discharge 16, and since the branch line 20 is upstream of the variable orifice 14, a signal is produced at $S_o$ which is proportional to the flow provided by the pump 10.

Figure 1:
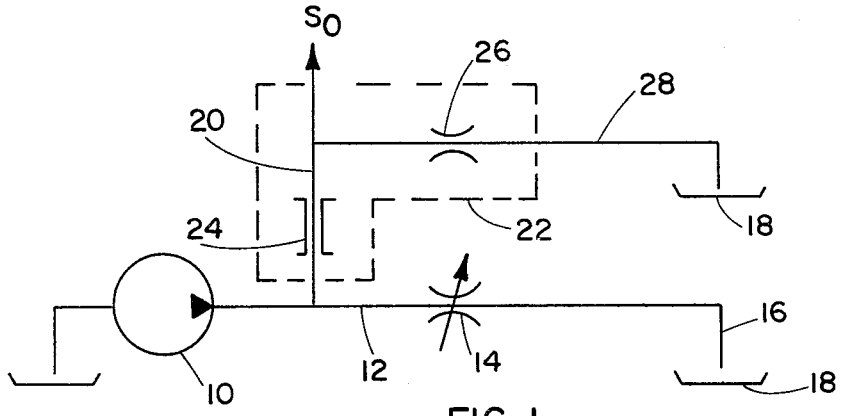
FIG. 1 is a schematic diagram of an equalizing viscosity compensating circuit of the present invention.

The circuit of FIG. 1 is intended to be used over a wide viscosity range because most of the pressure drop is across the orifice which, if perfect, will be relatively insensitive to oil viscosity. However, it is difficult to make an adjustable flow control means such as a variable orifice perfect and, also because of viscosity variable pump leakage, the resulting output flow can change significantly with viscosity changes. Thus the pressure signal $S_o$ will vary with oil viscosity changes. In order to overcome this, a viscosity compensating means 22 is added in a bridge-type circuit. The viscosity compensating means 22 comprises a capillary 24 in the branch line 20 and a fixed orifice 26 in a line 28 connecting the branch line 20 to the same reference pressure as the discharge 16 of the control line 12. Thus, if discharge 16 is to drain 18, line 28 also discharges to a drain 18.

A capillary, by its very nature being of small diameter and long length, is sensitive to the viscosity of a fluid flowing therethrough. The capillary 24 is sized to produce an increasing pressure drop upon an increase in fluid viscosity in proportion to the increasing pressure drop across the control means or variable orifice 14 caused by the increase in viscosity. Thus, the change in viscosity induced pressure drop across the variable orifice 14 is equalized by the change in viscosity induced pressure drop across the capillary 24. Therefore, for a given flow rate through line 16, the pressure output signal at $S_o$ is maintained as fluid viscosity changes. The fixed orifice 26 may be constructed to be insensitive to a change in viscosity of the control fluid, but it is not necessary for proper function of the system.

It is noted that the viscosity compensating means 22, comprising the capillary 24 and the fixed orifice 26, is in parallel relationship with the variable orifice 14. Therefore, the pressure drop, from the point of connection of the branch line 20 with the control line 12, across both the variable orifice 14 to the drain 18 and across the viscosity compensating means 22 to drain 18 through line 28 is the same. Capillary 24 is designed to have similar sensitivity to a change in viscosity as the control means 14 and orifice 26 so that the pressure drop due to a change in viscosity may be balanced in both branches of the parallel circuit. It is furthermore noted that the output signal $S_o$ is taken from the branch line 20 downstream of the capillary 4 but upstream of the fixed orifice 26. The signal $S_o$ so provided can thus be varied by the amount of flow provided by the pump 10 and the adjustment of the variable orifice 14, but is not varied by a change in fluid viscosity.

Since there is no pressure regulating valve in the circuit, which by its very nature requires a minimum operating pressure and also limits the maximum operating pressure, the control just described allows for viscosity compensation at any point of operation of pump 10. Therefore, no minimum pump pressure or maximum pump flow or related output pressure signal $S_o$ is required.

Figure 2:
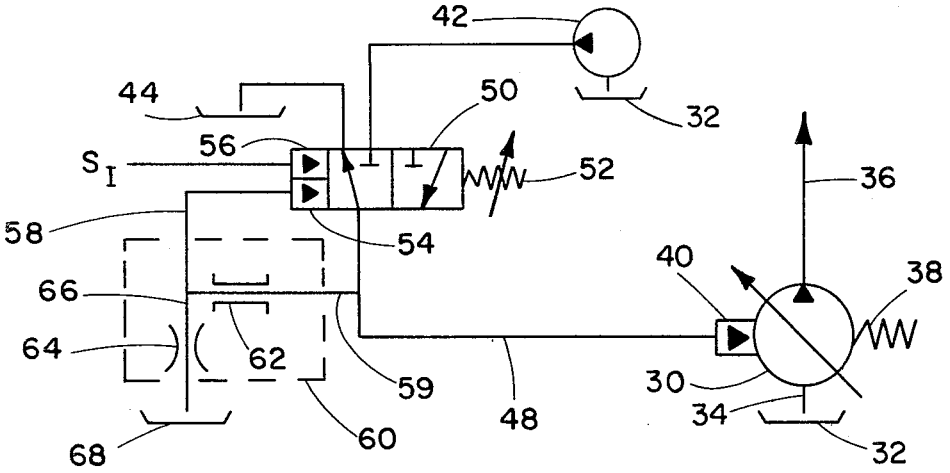
FIG. 2 is a schematic diagram showing a second embodiment utilizing an off-setting viscosity compensating means to control a circuit input.

FIG. 2 teaches a second embodiment of the present invention wherein the viscosity compensating means is used in a control circuit to modify a pump output in accordance with a change in viscosity of the hydraulic fluid. The input portion of the circuit taught comprises a variable displacement pump 30 which draws hydraulic fluid or oil from a reservoir 32 through an intake line 34. The pump 30 is of the variable displacement type such as the well-known axial piston pump whose displacement is controlled by the angular movement of the swash plate. By modifying the displacement of the pump 30, the volume of fluid flow to a pump outlet line 36 is controlled. One control on the displacement of the pump 30, and thus the flow to output line 36, is provided by a spring 38 which biases the pump 30 toward a full displacement position. Opposing the spring 38 is a pump control means 40 which, when pressure is applied thereto, acts against the spring 38 to bias the pump 30 toward a zero displacement position. Pump control means 40 and the spring 38 may be part of the well-known servo cylinder utilized with swash plate pumps such as taught in U.S. Pat. No. 4,246,806. While the particular variable displacement pump taught is spring biased toward the full displacement position, a variable displacement pump which is normally biased toward the zero displacement position may also be utilized with the control thereof reversed.

Figure 3:
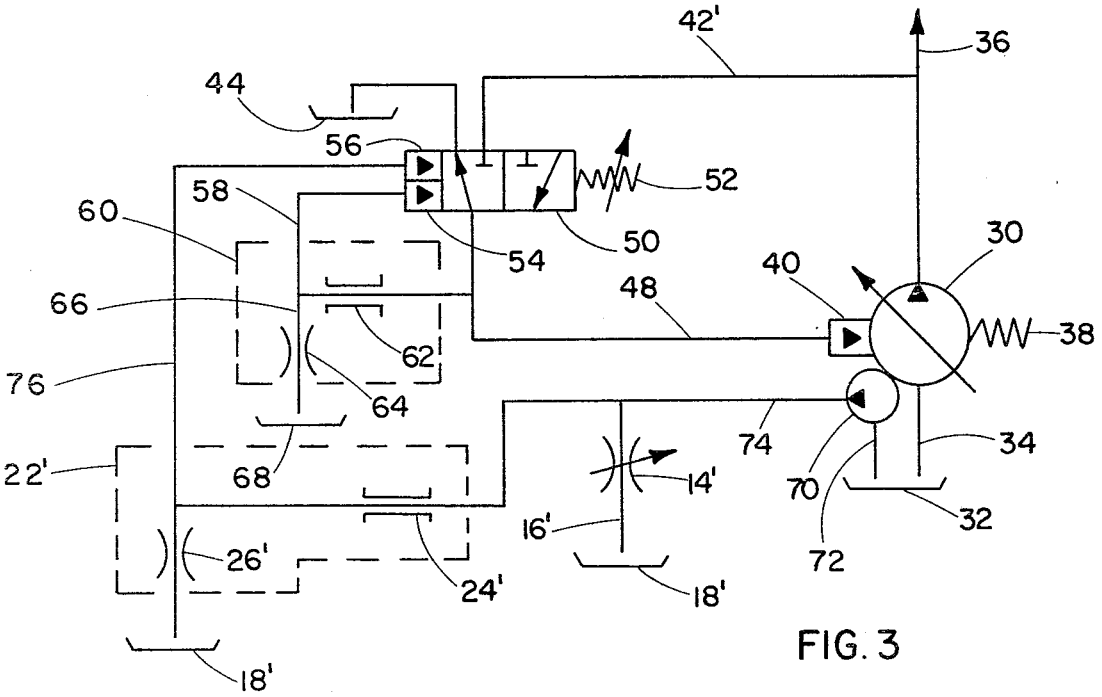
FIG. 3 is a schematic diagram of a modification of the embodiment of FIG. 2.

To modulate the pressure at pump control 40, and thus control the displacement of the pump 30, a control circuit is provided which has a source of fluid pressure such as a charge pump 42 normally associated with a hydrostatic transmission and drawing fluid from some reservoir 32 as pump 30. However, the pressure source, as seen in FIG. 3, could be a line 42' attached to the output line 36 of the variable displacement pump 30. Also associated with the control system is a sump or drain 44. The source of fluid pressure 42 and the drain 44 are selctively and modulatingly connected to a pump control line 48 by means of a valve 50. The valve 50 is normally spring biased towards the left by means of an adjustable spring 52 to apply pressure from the source of pressure 42 to the pump control 40 which biases the variable displacement pump 30 toward the zero displacement position. The adjustment of the spring 52 is normally factory set.

Balancing the force of the spring 52 are two valve pilots 54 and 56 also acting on the valve 50. The first valve pilot 54 is connected to the pump control line 48 by means of a branch line or valve pilot line 58–59. Since the valve pilot 54 acts against the adjustable spring 52, the pressure at valve pilot 54 is proportional to the force of the spring 52 (minus any pressure at valve pilot 56 as explained below). If for some reason, the pressure in valve pilot line 58–59 tends to be reduced, the spring 52 further opens the valve 50 to increase the pressure in pump control line 48 and which also raises the pressure in valve pilot line 58–59. In the reverse, if the pressure in valve pilot line 58–59 for some reason is increased, this will bias the valve 50 toward the right and thus further increases the pump control line 48 connection to drain 44. This reduces the pressure in line 48 and thus valve pilot line 58–59. Therefore, the valve pilot 54 modulates the valve 50 to maintain a constant pressure in valve pilot line 58–59 and thus valve pilot 54 which modulate the position of the valve 50.

Normally, a control of this type is utilized with a further input signal such as $S_I$ at valve pilot 56 in FIG. 2. The input signal $S_I$ is proportional to a parameter of the control system or a device being driven by the pump 30. One example of such signal $S_I$ is a speed signal to be discussed in detail later in conjunction with FIG. 3. Another input signal which could also be utilized is a pressure compensator signal. If a pressure compensator signal is utilized, it would normally be applied to the valve 50 in a valve opening position, and thus aligned with the spring 52 rather than opposed thereto. Regardless of what input signal $S_I$ is utilized, it would be constant for a given operating parameter and would be in addition to the modulation signal applied to valve pilot 54 caused by the pressure in valve pilot line 58. This system works well assuming a constant viscosity of the control fluid.

However, in conditions such as cold start-up, fluid viscosity is increased. Since the intake line 34 of the pump 30 is connected to a reservoir 32 which is normally at atmospheric pressure, there is limited pressure head at the pump inlet. Therefore, particularly under maximum stroke conditions and when the hydraulic fluid is of increased viscosity, the pump inlet pressure will be low and cavitation damage to the pump 30 can result. To off-set this adverse effect, it is desirable to reduce the displacement of the pump 30 under these conditions. To reduce the displacement of the pump 30, a higher pressure must be applied to the pump control 40.

Therefore, a viscosity compensating means 60 is added to the control circuit. The viscosity compensating means 60 comprises a capillary 62 in the portion 59 of the valve pilot line and a fixed orifice 64. The capillary 62, due to its length-to-diameter ratio, is sensitive to the change in fluid viscosity in the same manner as the capillary 24 of FIG. 1. The fixed orifice 64, which is similar to the fixed orifice 26 of FIG. 1, is provided on a drain line 66 leading to drain 68. The drain 68 may be common with the drain 44 and the reservoir 32 previously described.

As the viscosity of the fluid from the pump 42 increases, the resistance to flow to drain 68 through the capillary 62 in the branch valve pilot line 58 increases. This resistance to flow, in combination with the relatively constant pressure at valve pilot 54 caused by the force of the spring 52, increases the pressure drop across capillary 62 as flow in line 59 remains constant and thus increases the pressure in the pump control line 48. This increases the pressure at the pump control 40 to reduce the displacement of the pump 30 which in turn reduces any adverse cavitation effects.

It is further noted that the capillary 62 is in parallel relationship with valve pilot line 58 in a similar manner to the parallel relationship of the capillary 24 with the control line 12 of FIG. 1. It is also noted that a fixed orifice 64 is again in series relationship with the capillary 62 while the pump control 40 is similar to variable orifice 14 in that both are pressure sensitive to flow.

The control circuit of FIG. 1 is an equalizing circuit which maintains a constant pressure for the output signal $S_o$ regardless of fluid viscosity. The control circuit of FIG. 2 is an off-setting circuit with the constant pressure at valve pilot 54 modifying the pressure in pump control line 48. Upon a change in viscosity, the capillary 24 of FIG. 2 is utilized to maintain a constant pressure at the signal output $S_o$ and the capillary 62 of FIG. 2 is utilized to alter the pressure in pump control line 48 to change the displacement of the variable displacement pump 30 to off-set an adverse effect. Therefore, in FIG. 2, the hydraulic system performance is altered by the viscosity compensating means 60 to prevent cavitation or other adverse effects.

FIG. 3 teaches a modification to the embodiment taught in FIG. 2 but with the teaching of a specific input signal $S_I$. The hydraulic control system of FIG. 3 utilizes identical elements to that taught in FIG. 2 including the variable displacement pump 30, the modulating control valve 50 and the viscosity compensating means 60 with their associated elements.

One slight modification is replacement of the charge pump 42 in FIG. 2 with a line 42' connecting the valve 50 with the pump outlet line 36. This merely provides an alternative source of pressure for the control system such as mentioned above. In both cases, the viscosity compensating means is provided with the same fluid as pump 30.

The input signal $S_I$ to the valve pilot 56 has been replaced with a specific speed input signal. The control system is provided with a speed pump 70 which is of fixed displacement and driven with the variable displacement 30 at an identical speed thereto. The pump 70 being a fixed displacement, will have an output directly proportional to the speed thereof and thus proportional to the speed of the variable displacement pump 30. The pump 70 has its own intake line 72 drawing hydraulic fluid from the same reservoir 32 as the primary displacement pump 30. The pump 70 furthermore has an outlet line 74 connected to a speed signal pilot line 76 which is in turn connected to the valve pilot 56 acting on valve 50 in a direction opposite to the force of spring 52.

If an excessive hydraulic load is applied to the pump 30 by an abnormal increase in pressure in the pump outlet line 36, an increased load is applied to a prime mover driving the pump 30. An excessive load, applied through the pump 30 to the prime mover, can cause the prime mover to slow down to an undesirable condition or even stall. This is prevented by sensing the reduced speed of the variable pump 30 through the speed signal circuit and then reducing the displacement of the variable pump 30 to reduce its output. The reduction of speed of the speed signal pump 70 reduces the pressure at valve pilot 56 which allows the spring 52 to further bias the valve 50 to the left and thus increase the flow from line 42' to increase pressure in line 48 and pump control 40. As explained above, increased pressure at pump control 40 reduces the stroke of the variable displcement pump 30 and thus its flow output.

The speed signal pump 70, like any pump and as explained above, is also affected by a change in fluid viscosity. To compensate for the change in fluid viscosity, the speed signal circuit taught in FIG. 3 utilizes an equalizing viscosity compensating means 22' identical to means 22 taught in FIG. 1. Therefore, the speed pump outlet line 74 is provided with a capillary 24'. A fixed orifice 26' connects the speed signal pump outlet line 74 and the speed signal pilot line 78 to the same drain 18'. Upstream of the capillary 24', the speed pump outlet line 74 is provided with a variable orifice 14' and line 16' also leading to the drain 18'. Considering the speed pump 70 to be identical to pump 10 of FIG. 1, it is noted that like the viscosity compensation system of FIG. 1, the flow of speed pump 70 is directed to an identical reference pressure, i.e. the drain 18', through two parallel circuits, one consisting of the variable orifice 14' which is viscosity sensitive and the other including the capillary 24' which is also viscosity sensitive. As a matter of convenience, the sump 18' could be identical to the sumps 32, 68 and 44, also in the control circuit. It is furthermore noted that speed signal pilot line 76 is connected to the speed signal pump outlet line 74 at a point between the capillary 24' and the fixed orifice 26'. Therefore, the speed signal applied to the speed signal pilot 56 is proportional to the speed of the speed pump 70 and, due to the equalizing viscosity compensating circuit 22', is not affected by a change in fluid viscosity.

It can thus be seen that the embodiment of FIG. 3 utilizes both the off-setting viscosity compensating circuit of FIG. 2 to modify the pressure at pump control 40 to vary the displacement of pump 30 and the equalizing viscosity compensating circuit of FIG. 1 to provide a speed signal at valve pilot 56 which is not sensitive to a change in viscosity of the hydraulic fluid.

As can be ascertained from the aforesaid described structure and operation, the object of providing viscosity compensating means in a hydraulic control circuit to maintain a constant signal which is insensitive to a change in fluid viscosity or to provide a signal which compensates for change in fluid viscosity has been obtained. Although this invention has been illustrated and described in connection with the particular embodiments illustrated, it will be apparent to those skilled in the art that various changes can be made therein without departing from the spirit of the invention as set forth in the appended claims.

I claim:

1. A viscosity compensating control circuit for a variable displacement pump and including a source of fluid flow, a first line including a control element which is pressure sensitive to flow and which upon an increase in pressure applied thereto decreases the displacement of said pump, a second line in parallel flow relationship to said first line and including a capillary and a flow restriction means in series flow relationship, a branch line connected to said second line between said capillary and said flow restriction means, said first and second lines being connected to said source of fluid flow by a pilot operated valve to control flow from said source to said first and second lines, said branch line includes a pilot for controlling the position of said valve to moduate flow to said control element and through said capillary to said branch line and said flow restriction means which are in parallel relationship, the pressure upstream of said flow restriction means and said control element determining the amount of flow across said capillary, and the pressure drop across said capillary raises the pressure at said control element to compensate for increases in viscosity of the fluid which decreases the displacement of said pump to reduce the fluid flow of said pump.

2. A viscosity compensating control circuit including a control line with a source of fluid flow, a branch line connected to said control line, flow control means in said control line for controlling the flow of fluid through said control line to establish fluid pressure in said branch line, said flow control means being sensitive to a change in fluid viscosity and having a pressure drop related to flow through said flow control means, the improvement comprising viscosity compensating means associated with said control line and in parallel relationship to said flow control means to modify the flow of fluid through said control line upon a change in fluid viscosity to maintain a control pressure in said branch line that is insensitive to the change in fluid viscosity, said viscosity compensating means including capillary means in said branch line and flow restricting means connected directly in series with and downstream of said capillary means, said branch line control pressure being established between said capillary and said flow restricting means by the divided flow from said source through both said control means and said flow restricting means with the divided flow being in the order of relatively equal proportions.

3. The viscosity compensating circuit of claim 2 including a reference pressure and wherein said flow restricting means and said flow control means are directly connected to the reference pressure.

4. The viscosity compensating circuit of claim 3 wherein the reference pressure is drain.

5. The viscosity compensating circuit of claim 2 wherein said flow restricting means is a fixed orifice.

6. A viscosity compensating hydraulic control circuit including a pump for producing a supply of control fluid to a control line, a flow control means for controlling the flow of the control fluid through said control line toward a reference pressure to maintain a given pressure upstream of said control means, said flow control means being sensitive to a change in the viscosity of the control fluid and having a pressure drop related to flow through said flow control means, the improvement comprising viscosity compensating means including a capillary in said circuit upstream and in parallel relationship with said flow control means, and a fixed orifice in direct series relationship with said capillary between said capillary and the reference pressure wherein said control circuit provides relatively equal parallel flow to maintain a pressure signal substantially insensitive to a change in fluid viscosity located upstream of said flow control means and said fixed orifice and downstream of capillary.

7. The viscosity compensating circuit of claim 6 wherein said pump is of fixed displacement and the pressure signal to said control system is proportional to the speed of said pump irrespective of the viscosity of the control fluid.

8. The viscosity compensating circuit of claim 7 wherein said flow control means is a variable orifice.

9. The viscosity compensating circuit of claim 7 wherein said reference pressure is drain and said variable orifice and said fixed orifice are in parallel relationship and connected directly to drain.

10. An equalizing hydraulic supply circuit comprising a pump providing a flow of control fluid, a drain, a line connecting the output of said pump and said drain, a variable orifice controlling flow through said line and sensitive to fluid viscosity in said line, a branch line connected to said line between said pump and said variable orifice, a capillary in said branch line and in parallel relationship to said variable orifice, a pressure signal output in said branch line downstream of said capillary, and a fixed orifice connected to said branch line between said capillary and said signal output and connecting said branch line directly to said drain, the division of flow through said first line and said branch line maintaining said pressure signal output substantially insensitive to viscosity of the control fluid.

11. The equalizing hydraulic supply circuit of claim 10 wherein said pump is of fixed displacement and whereby the pressure signal is proportional to the speed of said pump.

12. A hydraulic control circuit including a variable displacement pump, pump control means for modifying the displacement of said pump, a pump control line connecting said pump control means to a source of pressure, a valve in said pump control line for modulating the pressure at said pump control means, valve pilot means for modulating the position of said valve, a branch line connecting said valve pilot means to said pump control line, the improvement comprising viscosity compensating means to vary the pressure in said pump control line in response to a change in viscosity of the control fluid, said viscosity compensating means including capillary means in said branch line, a drain, and flow restrictive means directly in series with said capillary means and connected to said branch line between said capillary and said valve pilot means for connecting said branch line to said drain.

13. The hydraulic control circuit of claim 12 wherein said source of pressure is the output of said variable displacement pump and is obtained by a line connecting said valve to the outlet of said pump.

14. The hydraulic control circuit of claim 12 wherein said pump is normally biased toward full displacement and said valve is normally biased toward maximum flow through said pump control line, and including drain means connected to said valve, said valve being biased by said valve pilot toward a position restricting flow through said pump control line and increasing the flow between said pump control means and drain.

15. The hydraulic control circuit of claim 12 including a fixed displacement pump driven at the same speed as said pump to produce a speed signal proportional to the speed of said pump, speed signal pilot means on said valve, a speed signal line interconnecting said fixed displacement pump and said speed signal valve pilot whereby an increase in pump speed biases said valve toward a position reducing flow to said pump control line to increase the displacement of said pump and a decrease in pump speed biases said valve toward a position increasing flow to said pump control line to decrease the displacement of said pump.

16. The hydraulic control circuit of claim 15 including a second viscosity compensating means in said speed signal line to modify the speed signal in accordance with the change of viscosity of the control fluid, said second viscosity compensating means comprising a second capillary in said speed signal line, a variable orifice connecting said speed signal line upstream of said second capillary to drain, and a fixed orifice connecting said speed signal line downstream of said second capillary to drain.

17. A viscosity compensating control circuit including a variable displacement pump, a first line including a control element which is pressure sensitive to flow and which, upon an increase in pressure applied thereto, decreases the displacement of said pump, a second line in parallel flow relationship to said first line and including a capillary and a flow restriction means in series flow relationship, a branch line connected to said second line between said capillary and said flow restriction means, said first and second lines being connected to said variable displacement pump by a pilot operated valve to control flow from said pump to said first and second lines, said branch line includes a pilot for controlling the position of said valve to modulate flow to said control element and through said capillary to said branch line and said flow restriction means which are in parallel relationship, the pressure upstream of said flow restriction means and said control element determining the amount of flow across said capillary, and the pressure drop across said capillary modifies the pressure upstream of said control element to compensate for changes in viscosity of the fluid, and wherein an increase in viscosity of said fluid increases the pressure drop across said capillary to increase the pressure at said control element which decreases the displacement of said pump to reduce the fluid flow of said pump.

* * * * *